US006315665B1

(12) United States Patent
Faith

(10) Patent No.: US 6,315,665 B1
(45) Date of Patent: Nov. 13, 2001

(54) ARCADE GAME

(76) Inventor: William B. Faith, 1307 Blue Sail Cir., Westlake Village, CA (US) 91361

( * ) Notice: Subject to any disclaimer, the term of this patent is extended or adjusted under 35 U.S.C. 154(b) by 0 days.

(21) Appl. No.: 09/535,423

(22) Filed: Mar. 27, 2000

(51) Int. Cl.[7] ..... A63F 9/24
(52) U.S. Cl. ..... 463/23; 463/16
(58) Field of Search ..... 463/16, 23, 25; 273/440, 447; 222/23

(56) References Cited

U.S. PATENT DOCUMENTS 5,816,918 * 10/1998 Kelly et al. ..... 463/16
6,007,426 * 12/1999 Kelly et al. ..... 463/16
6,015,344 * 1/2000 Kelly et al. ..... 463/16
6,165,070 * 12/2000 Nolte et al. ..... 463/20
6,193,606 * 2/2001 Walker et al. ..... 463/20
6,234,487 * 5/2001 Shoemaker, Jr. ..... 273/447

* cited by examiner

*Primary Examiner*—Raleigh W. Chlu
(74) *Attorney, Agent, or Firm*—Lyon & Lyon LLP

(57) ABSTRACT

An arcade game accepts player selection of a specific prize before the game is started. Preferably, the difficulty level of the game is proportional to the value of the selected prize. In addition, the difficulty level of the game is preferably proportional to the number of monetary units inserted into the machine by the player, such that the game becomes less difficult as the player inserts additional monetary units into the machine. The machine preferably dispenses the selected prize to the player when the player inserts monetary units into the machine equivalent to the value of the prize.

11 Claims, 6 Drawing Sheets

STEP 306
500
ARE THERE ANY CREDITS AVAILABLE?
502
GAME UNIT REQUESTS CREDITS
YES
504
WAS THE SLOW DOWN BUTTON PRESSED?
NO
YES
SLOW DOWN LIGHTS BY A COST FACTOR OF ONE. DECREASE THE NUMBER OF CREDITS BY ONE.
506
508
ACTIVE GAME LIGHT STOPPED?
NO
PLAY GAME?
NO
YES
STEP 308
YES
1
1
510
MOVE CONSOLE LIGHT TO WIN, DISPENSE PRIZE
GO INTO WIN MODE
PRIZE BOUGHT
512

ARCADE GAME

BACKGROUND OF THE INVENTION

The field of invention is arcade games.

One type of arcade game that is popular in family amusement centers around the country is the redemption game. A redemption game in one in which the player is awarded with tickets, tokens or other items redeemable for prizes. Such prizes are typically displayed at a central location, and are given to players who collect enough tickets to redeem them for a desired prize. Such games, and the prizes associated with them, are commonly seen in locations such as family amusement centers and in pizza restaurants oriented toward children. A problem with the redemption game is the lack of excitement associated with winning tickets, tokens or other items redeemable for prizes. It is less exciting to win a paper stub than an actual item. Thus, players may be lured to seek excitement elsewhere, resulting in lost revenue for the owner of the redemption game. Another problem is the need to set up and administer an area for redemption of tickets or tokens for gifts. A person must be present to monitor the goods and to perform the redemption, and storage space for the goods is required. Another problem is the potential for counterfeiting tickets, or passing off tickets from other sources as those redeemable for goods. The tickets dispensed from the redemption game typically do not contain security features, rendering them liable to counterfeiting. Further, inattention or carelessness of the attendant can allow other types of tickets to be passed off as redeemable ones, allowing an unscrupulous player to obtain a higher-value item than he or she is legitimately entitled to.

In an attempt to overcome the problems of redemption games, prize games were introduced, which dispense prizes directly from the game machine itself. Typically, such machines include a game of skill wherein the player controls some aspect of the game, such as the apparent motion of a light around a circle of lightbulbs, or the motion of a coin through the apparatus, as disclosed in U.S. Pat. No. 5,326,108 and U.S. Pat. No. 5,445,138. The player selects a location to stop the apparent motion of the light with a controller switch, and wins the prize, if any, corresponding to the selected final location of the light. One problem with this prize game is that the difficulty level is uniform across the prizes, and is therefore not proportional to the value of the prize. Thus, a player may be as likely to win a low-value prize, such as an eraser or gum, as a high-value prize, such as a portable radio or disposable camera. This may be frustrating to the player, who would prefer to play for a high-value prize, and for the owner of the machine, who is substantially as likely to give away high-value items as low-value ones. The owner may attempt to compensate by inserting more low-value prizes into the machine; however, a machine filled with low-value prizes is less likely to attract players, and thus less likely to generate revenue for the owner.

Another problem with known prize games is the lack of visibility into the difficulty level by the player. The difficulty level is typically invisible to the player before he or she begins play, and may remain invisible to the player even during and after play. For example, in some known prize games involving moving lights in a pattern of light bulbs, the light always moves at substantially the same speed. As the light moves in front of the prize, the player attempts to stop the light and win the prize. Because the light moves at substantially the same speed at all times, it is in front of the prize for a fixed amount of time; for example, 100 milliseconds. However, it is known to adjust the difficulty level of the game by providing a time less than the time the light is in front of the prize in which the player must select the light. For example, if the light is in front of the prize from 100 milliseconds, the game machine may be set to allow the light to continue past the prize unless the player stops the light in 70 milliseconds, or 50 milliseconds, or another time period less than 100 milliseconds which is preset by the owner of the machine. The player never has any visibility into the source of the difficulty, and may eventually grow disenchanted with the prize game, as the player never understands why he or she always seems to lose, and has no idea how to improve his or her skills at the prize game.

Another problem with known prize games is the invariability of the difficulty level. Typically, the difficulty level is preset by the owner at a certain level, and is constant for all players of the prize game. The preset may only be changed by the owner of the prize game, typically by removing a portion of the machine and manually resetting one or more DIP switches within the machine itself. Because the difficulty level is typically the same across all prizes in the machine, the preset difficulty level has the effect of making the prize game more generous, or more stingy, with every prize in the prize game.

SUMMARY OF THE PREFERRED EMBODIMENTS

In one aspect of a preferred embodiment, the game accepts player selection of a specific prize before the game is started.

In another aspect of a preferred embodiment, the difficulty level of the game is proportional to the value of the selected prize.

In another aspect of a preferred embodiment, the difficulty level of the game is proportional to the value inserted into the machine by the player, such that the game becomes less difficult as the player inserts additional value into the machine. In a further aspect of a preferred embodiment, the machine dispenses the prize to the player when the player inserts monetary units into the machine equivalent to the value of the prize.

DETAILED DESCRIPTION OF THE PREFERRED EMBODIMENTS

Figure 1:
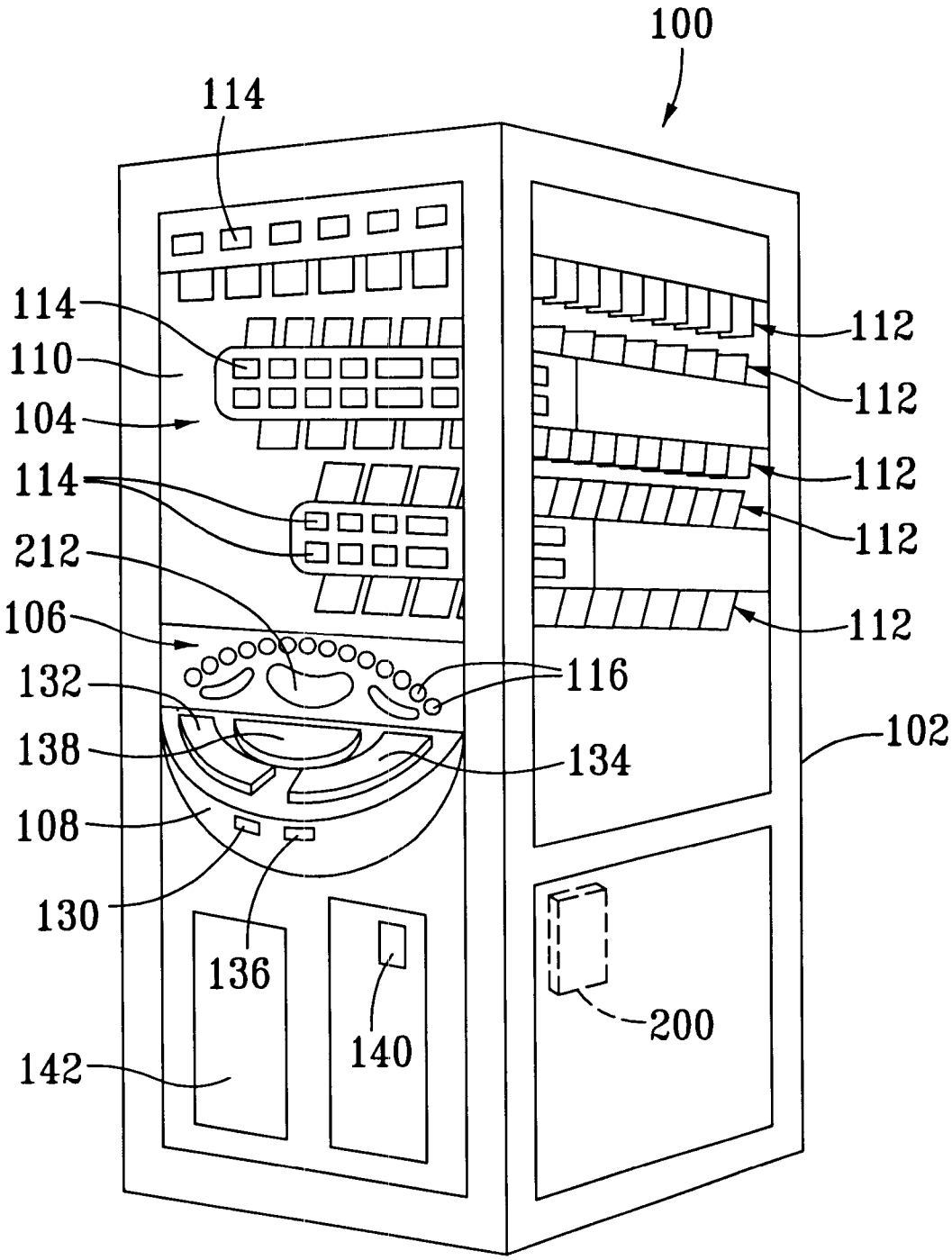
FIG. 1 is a perspective view of the arcade game.

Referring to FIG. 1, a game unit 100 includes a cabinet 102. In a preferred embodiment, a dispensing unit 104 is located within the cabinet 102. However, it is within the scope of the preferred embodiment to provide a dispensing unit 104 separate from but electrically connected to the cabinet 102. A skill game 106 is preferably located on the front face of the cabinet 102, and game controls 108 are preferably located on the front face of the cabinet 102 adjacent to the skill game 106. Of course, different configurations of the game unit 100 will be apparent to those skilled in the art.

The dispensing unit 104 is preferably constructed and operated in the same way as a standard vending machine, which is known to those skilled in the art. The dispensing unit 104 may take the form of any vending mechanism that allows for the display of a number of different prizes. By way of example and not limitation, the dispensing unit 104 may be constructed according to U.S. Pat. No. 5,326,108 and U.S. Pat. No. 5,445,138, both of which are herein incorporated by reference. Other configurations of the dispensing unit 104 are also possible. The dispensing unit 104 preferably includes a clear panel 110 through which the prizes 112 to be dispensed may be seen. In a preferred embodiment, the dispensing unit 104 includes several rows of prizes 112, each having a vending light 114 at the front. The function of these vending lights 114 will be described in greater detail below. It is within the scope of the preferred embodiment to provide a dispensing unit 104 having an opaque front panel, where representative prizes 112 or a list of prizes 112 is displayed to the player, but the rows of prizes 112 themselves are not seen.

The skill game 106 includes a plurality of game lights 116, preferably arranged in an arc on the front side of the cabinet 102. The game lights 116 are preferably light bulbs behind translucent covers, which may have various colors or legends.

The game controls 108 preferably include a select button 130, a scroll left button 132, a scroll right button 134, a slow lights button 136 and a stop button 138. The buttons may be constructed in any way that allows the player to press a button and cause the desired result. It is within the scope of the preferred embodiment to utilize fewer game controls 108, where one button may be used for different purposes at different times. While the game controls 108 are mechanical in nature in a preferred embodiment, any type of game control 108 may be used that allows the game unit 100 to function.

The cabinet 102 also includes a receiver 140 for receiving monetary units from a player. As used in this specification, the phrase "monetary units" refers not only to government-issued money such as coins and Federal Reserve Notes, but also tokens, magnetic cards, credit cards, and any other representation of money that can be transferred from the player to the game unit 100. Thus, the receiver 140 may be a coin slot, a slot for a magnetic card or credit card, or other structure for receiving monetary units from a player. In a preferred embodiment, the receiver 140 is a coin slot for receiving coins, tokens or both. It is within the scope of the preferred embodiment to provide a connection between the game unit 100 and a remote computer via a modem and a telephone line, a network card and a telephone, coaxial or fiber line, or through any another structure allowing the game unit 102 to communicate with a remote computer capable of authorizing and authenticating a credit card or debit card inserted into the receiver 140, or to communicate with a remote computer holding monetary units belonging to the player and transfer a selected number of those monetary units to the game unit 100.

A prize dispensing door 142 is also included in the front of the cabinet 102. When the player wins a prize 112, the dispensing unit 104 releases that prize 112, which falls into an area behind the prize dispensing door 142. The player may then open the prize dispensing door 142 and remove the prize 112. Preferably, the prize dispensing door 142 includes one or more security features known to those skilled in the art, to prevent a player from reaching into the cabinet 102 and stealing prizes 112. It is within the scope of the preferred embodiment for prizes 112 to be dispensed in a different manner, such as but not limited to a plurality of prize dispensing doors 142 used in conjunction with a tiered carousel-style dispensing unit 104.

Figure 2:
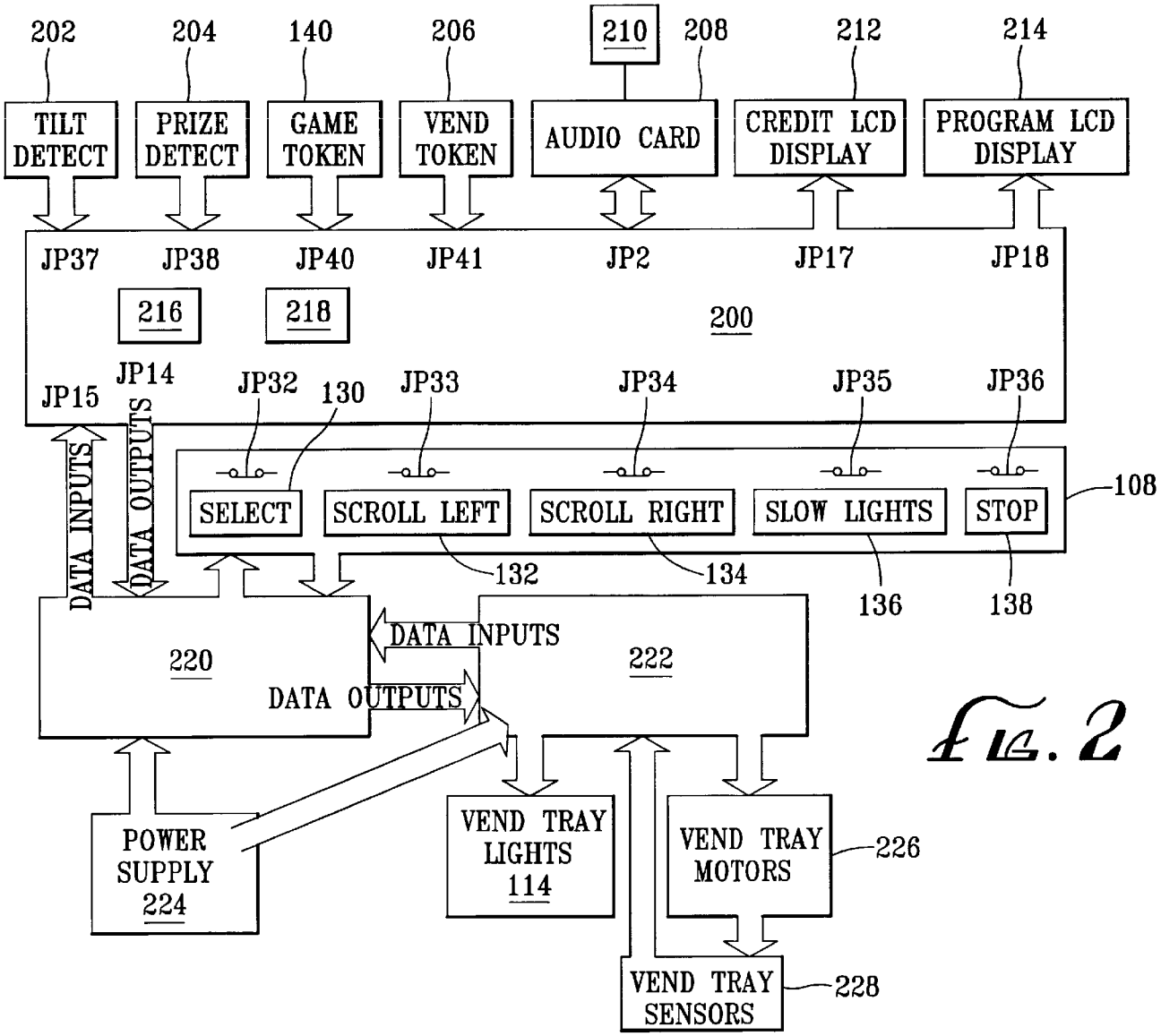
FIG. 2 is a high-level schematic of the arcade game.

Referring to FIG. 2, a high-level schematic of the game unit 100 is shown. A game controller 200 preferably includes one or more integrated circuits or microprocessor chips mounted to a printed circuit board. The implementation of a simple programmable control system such as the game controller 200 is known to those skilled in the art, and will not be discussed in great detail here. The game controller 200 is located within the cabinet 102, as shown schematically in FIG. 1.

Referring back to FIG. 2, the game controller 200 is electrically connected to the select button 130, the scroll left button 132, the scroll right button 134, the slow lights button 136 and the stop button 138. The game controller 200 can thus determine the state of these buttons, and determine when they have been depressed. The game controller 200 is also electrically connected to the vending lights 114 and the game lights 116 to control whether each of those lights is on or off at a given time. It is within the scope of the preferred embodiment to connect the game controller 200 to the vending lights 114 and the game lights 116 directly, or through an intermediate card or other electronic component.

The game controller 200 is also electrically connected to several other devices or controllers. In a preferred embodiment, the game unit 100 includes a tilt detector 202 which is electrically connected to the game controller 200. The tilt detector 202 may be omitted if desired. The game controller 200 is also preferably connected to a prize detector 204. Preferably, the prize detector 204 detects whether a prize 112 has moved into position behind the prize dispensing door 142, such that the prize dispensing door 142 may be unlocked to allow access to the prize 112. The game controller 200 is also electrically connected to the receiver 140, allowing the game controller 200 to count the number of coins, tokens or other monetary units placed in the game unit 100 by a player. Sensors to detect the input of monetary units into the game unit 100 are known to those skilled in the art. The game controller 200 is preferably also electrically connected to a refund controller 206, which dispenses coins, tokens or other monetary units back to the player in the event that the player has inserted too many, or changes his or her mind about playing the skill game 106. The game controller 200 is also electrically connected to an audio card 208, which is in turn connected to one or more speakers 210. The audio card 208 may alternately be included in the game controller 200, as a chip or other device directly attached to the printed circuit board. The use of the audio card 208 in generating sound from a digital input is known to those skilled in the art. The game controller 200 is also electrically connected to a credit display 212, which is preferably located on the front face of the cabinet 102. The credit display 212 shows the player how many credits he or she has received in exchange for the coins or tokens inserted into the receiver 140. That is, each monetary unit received by the receiver 140 has some value in terms of game credits. For example, the game controller 200 may be preset such that one game credit may be obtained for one quarter, or for two quarters, or for some other amount of money. The credit display 212 is preferably an LCD display, but may be any type of display which can show the player the number of credits he or she possesses, such as but not limited to an LED display or a cathode ray tube. The game controller 200 is preferably also electrically connected to a program display 214 located within the cabinet 102. The program display 214 is used by the owner or operator of the game unit 100 to display programmable game settings, which are described in greater detail below. The program display 214 is preferably an LCD display, but may be another type of display, such as a cathode ray tube, if desired. The program display 214 may alternately be ajack or other connector to which a monitor or other display may be connected when needed.

The game controller 200 preferably includes one or more DIP switches 216 which may be used by the owner of the game unit 100 to change various items stored in the game controller 200, as will be described in greater detail below. The game controller 200 may also include one or more programming inputs 218, such as a keyboard, keypad or connector to an outside input device or computer, to provide for simpler reprogramming of such items stored in the game controller 200. The game controller 200 includes memory (not shown), such as programmable ROM chips, or RAM chips, to store information and programming for the operation of the game. Preset values selected by the operator of the game unit 100 may be stored in memory in the game controller 200, instead of or in addition to the use of the DIP switches 216.

The game controller 200 is preferably electrically connected to a first vend board 220, which in turn is electrically connected to a second vend board 222. The electrical connections between the game controller and these boards allows for the transmission of data between them. It is within the scope of the preferred embodiment to combine the first vend board 220 and the second vend board 222 into a single vend board, or to add the first vend board 220 and the second vend board 222 to the game controller 200, eliminating the separate vend boards altogether. The first vend board 220 is connected to a power supply 224, which preferably provides 12 volt DC power to the first vend board 220. The first vend board 220 is also preferably connected to the game controls 108, receiving input from the game controls 108, actuating vending lights 114, and dispensing a prize 112 in response to a player win. The first vend board 220 is electrically connected to the second vend board 222, and data is transmitted between them. The second vend board 222 is also preferably connected to the power supply 224. The second vend board 222 is preferably connected to the vending lights 114 and to mechanisms in the dispensing unit 104 used to release a prize 112 after it has been won, such as motors 226 and sensors 228. Such motors 226 and sensors 228 for use in dispensing a prize 112 are well known in the art.

Figure 3:
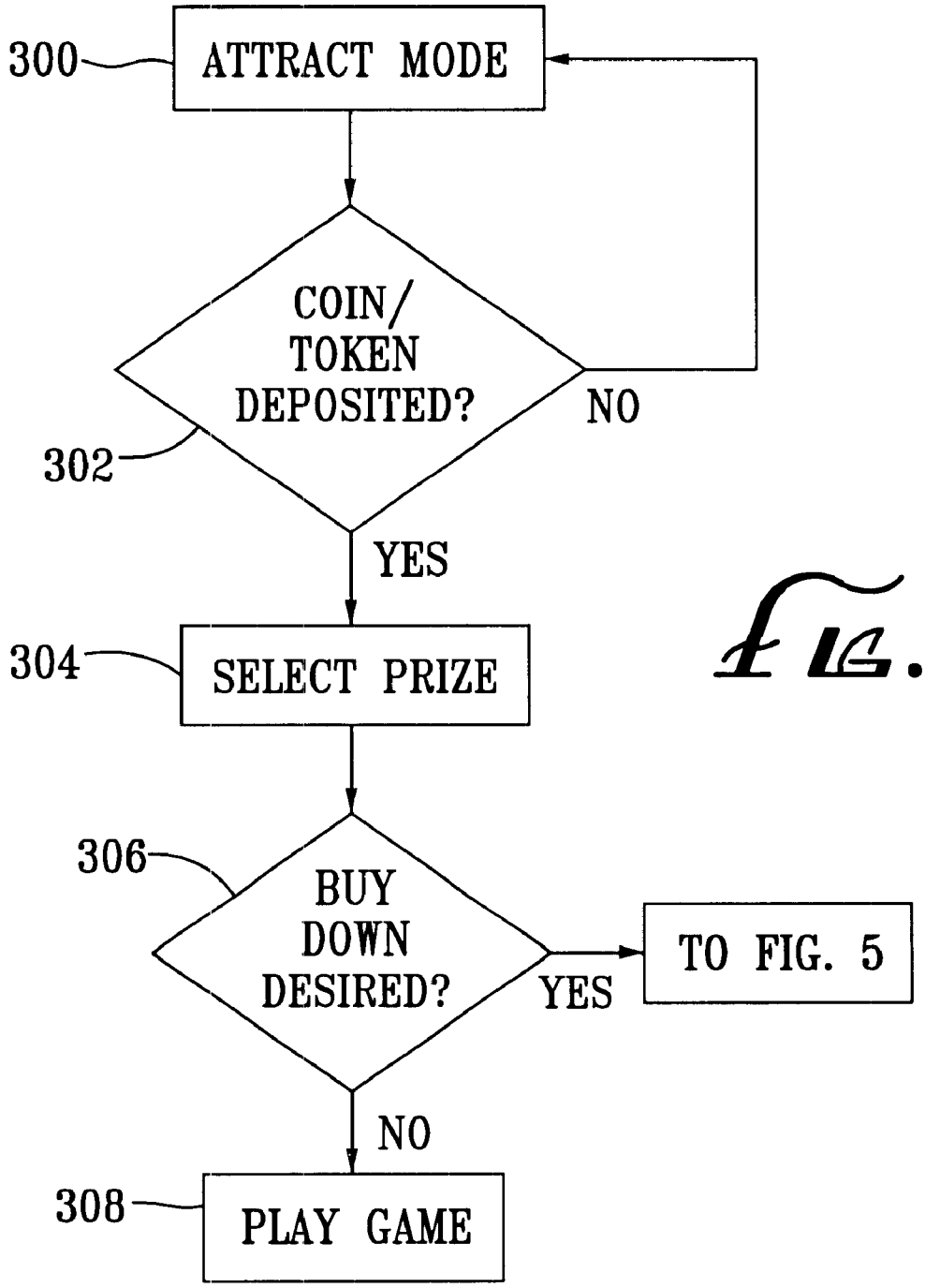
FIG. 3 is a flow chart illustrating the process of operating the arcade game.

Referring to FIG. 3, a flow chart of the game is shown. In the first step, step 300, the game is in attract mode. The function of the attract mode is to attract a person to the game unit 100 and entice that person to play the game. During the attract mode, sounds may be played such as, but not limited to, noises, songs, simulated voices and the like, in order to attract attention to the game unit 100. Additionally, lights on the game unit 100 may blink on and off or blink in patterns. Such lights include the vending lights 114 in the dispensing unit and the game lights 116 of the skill game 106 itself. Because the specific details of the attract mode are aesthetic, the implementation of specific sounds and of specific flashing light patterns may vary but will be within the scope of the preferred embodiment. As discussed above, the prizes 112 are preferably arranged in several rows within the dispensing unit 104, with a vending light at the front of each row. In one preferred embodiment, the lights 114 within the dispensing unit 104 begin turning on from the upper left corner of the dispensing unit 104 and continue turning on moving right from the top left light 114 in the dispensing unit 104. The next row of vending lights 114 underneath then lights up in the same way. In one preferred embodiment, all of the vending lights 114 are lit after substantially two seconds. All of the vending lights 114 may then be turned off after one second, after which the sequence is repeated. In a preferred embodiment, after the sequence is repeated three times, all of the vending lights 114 begin flashing on and off in one second intervals for approximately two to three seconds. This may repeat six times. In a preferred embodiment, the vending lights 114 are then turned off. In a preferred embodiment, the leftmost vending lights 114 are turned on as are the rightmost vending lights 114. Moving toward the middle, additional vending lights 114 are turned on until all of the vending lights 114 are lit. The process then reverses, the vending lights 114 turning off sequentially from the middle to the right and left sides. This pattern is then repeated three times. Of course, it will be appreciated that the attract mode may include a number of different patterns and, in fact, may not utilize any of these light patterns at all. Further, the dispensing unit 104 may not include vending lights 114 at all, and instead may include other lights in a different area of the cabinet 102. It is also within the scope of the preferred embodiment that no lights flash in the attract mode, and that sounds or other visual stimuli are used instead to attract attention. In another preferred embodiment, the attract mode 300 is not utilized at all, and the game unit 100 is silent until a coin or token is placed in the receiver 140. Moving to step 302, when a coin or token is deposited in the receiver 140, the attract mode ends and the game moves to step 304 where a prize is selected. If no coin or token is deposited in the receiver 140 in step 302, then the attract mode 300 is repeated. Of course, the attract mode has no minimum duration, and it ends substantially immediately after a player has inserted sufficient coins or tokens into the receiver 140 to allow that player to play a game.

Figure 4:
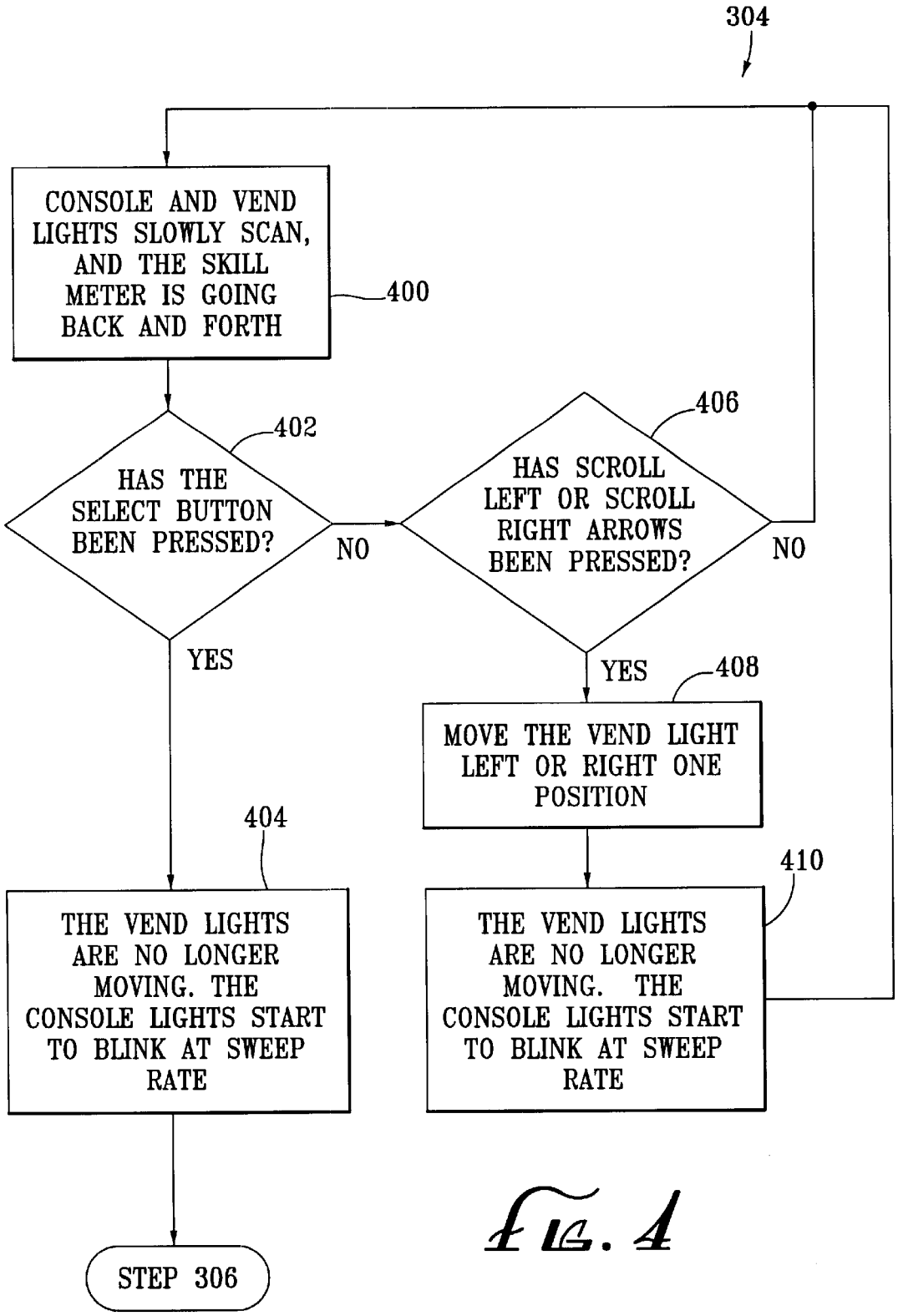
FIG. 4 is a flow chart illustrating the process of selecting a prize.

Step 304, the step of selecting the prize, is described in greater detail in FIG. 4. In step 400, the vending lights 114 are turned off except for one. The single vending light 114 which is turned on and emitting light at a given moment may be referred to as the active vending light 114. Preferably, the initial position of the active vending light 114 is at or near the center of the dispensing unit 104; however, the initial position of the active vending light 114 may be at any vending light 114. The active vending light 114 then slowly moves through the dispensing unit 104. That is, the active vending light 114 which is initially lit turns off, and an adjacent vending light 114 turns on. By turning on an adjacent vending light 114, the player perceives motion of the active vending light 114 across rows of prizes 112 in the dispensing unit 104. In this way the active vending light 114 moves through the dispensing unit 104,. Absent input from the player, the active vending light 114 will continue to move through the dispensing unit 104, eventually highlighting in turn all of the prizes 12. When the active vending light 114 moves in front of a specific prize 112, the active vending light 114 pauses there for a preset period of time, preferably on the order of a few seconds. As the active vending light 114 pauses in front of a specific prize 112, the game lights 116 in the skill game 106 sweep back and forth at the same rate they would move during the skill game 106. The difficulty of the skill game 106, as will be explained in more detail below, comes primarily from the speed at which the active game light 116 moves. In the skill game 106, a plurality of lights 116 are lighted sequentially, thereby giving the illusion that a single light is moving back and forth. The game light 116 which is lit at any given moment is referred to as the active game light 116. The slower that the game light moves, the easier the game is to play. The difficulty level of the skill game 106 depends on the value of the prize 112.

The value of each prize 112 is preset in the game controller 200; that preset can be altered by the operator of the game unit 100 as different prizes are loaded into the dispensing unit 104. Entry of prize values into the game controller 200 may be performed through the DIP switches 216 or the programming input 218. When the active vending light 114 comes to a stop in front of a prize 112, the game controller 200 identifies the value of that specific prize 112 and adjusts the difficulty level of the skill game 106 accordingly, to show the player how difficult the skill game 106 will be if the player selects that specific prize 112. The higher the value of the prize, the higher the difficulty level of the skill game 106.

To better describe the difficulty level of the skill game 106, the mechanics of play of the skill game 106 will be discussed. The skill game 106 consists of an active game light 116 moving along a series of lights 116, at least one of which is identified as a win light 116. The object of the game is to stop the active game light 116 in the position of the win light 116; if this is done, the player wins the selected prize. As the speed of the active game light 116 along the series of lights 116 increases, it becomes more difficult to stop the active game light 116 in the winning position. As discussed earlier, the apparent motion of the active game light 116 is simply a perception arising from the shutdown of one game light 116 and the activation of an adjacent game light 116. To make the active game light 116 move faster, each individual game light 116 is lit for a shorter time. Thus, to win the skill game 106 as the difficulty level increases, the player must press the stop button 138 during the shorter period of time during which the win light 116 is on. In a preferred embodiment, the game controller 200 changes the difficulty among a plurality of discrete and preset levels, depending on the value of the selected prize.

Moving to step 402, when the game controller 200 senses that the select button 130 has been pressed, the active vending light 114 stops moving, and the process moves to step 404, in which a specific prize 112 has been selected. By pressing the select button 130, the player selects a specific prize 112 for which he or she wishes to play. Because the difficulty level of the skill game 106 associated with that particular prize 112 was displayed to the player before the player selected that specific prize 112, the player knows the difficulty level to expect from the skill game 106. The active game light 116 sweeps back and forth at the rate associated with that difficulty level. The process then moves to step 306.

If in step 402, the select button 130 had not been pressed, the process moves to step 406 where the game controller 200 senses whether the scroll left button 132 or the scroll right button 134 have been pressed. The scroll left button 132 and the scroll right button 134 allow the player to actively move the active vending light 114 within the dispensing unit 104. If the game controller 200 senses that the scroll left button 132 or the scroll right button 134 has been pressed, the process moves to step 408. If the scroll left button 132 is pushed, the active vending light 114 moves left one position. If the active vending light was previously at a leftmost position within a row, then the light preferably moves one row above to the rightmost vending light 114. However, it is within the scope of the preferred embodiment that the light move in a different way, for example, to the bottom right vending light 114. If the scroll right button 134 is pressed, the active vending light 114 moves one position to the right. If the active vending light already in the rightmost position in one row, then the active vending light 114 preferably moves one row down to the leftmost position. As with the scroll left button 130, however, the motion of the active vending light 114 may be programmed differently. The player thus controls the motion of the active vending light 114, rather than waiting for the game controller 200 to move the active vending light 114 in the dispensing unit 104. In a preferred embodiment, if the scroll left button 132 or the scroll right button 134 is pressed, and the player then does not press either button for a preset period of time, the game controller 200 senses the absence of input and begins to move the active vending light 114 automatically once again. Moving to step 410, as the player actively moves the active vending light 114 in front a prize 112, the active game light 116 moves at a speed corresponding to the difficulty level associated with that prize 112, just as when the active vending light 114 is automatically moved in front of the prize 112. The process then returns to step 402.

Referring back to FIG. 3, in step 306, the player has the option to buy down the prize 112. The buy down function allows the player to reduce the difficulty level associated with the selected prize 112, or buy the selected prize outright. If the player does not wish to buy down the selected prize, the process moves to step 308. If the player does wish to buy down the selected prize, then the buy down function is initiated.

Figure 5:
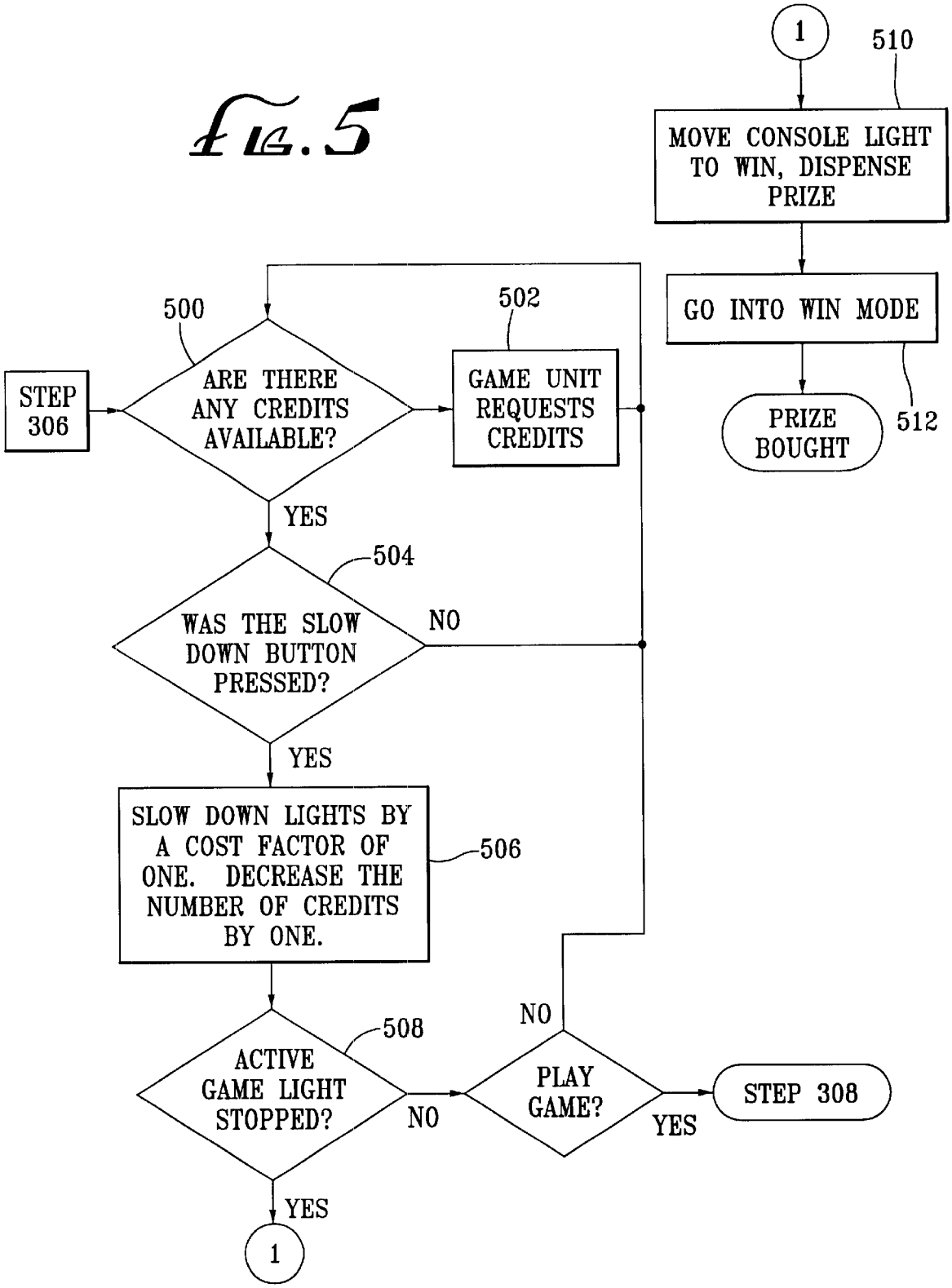
FIG. 5 is a flow chart illustrating the process of buying down the difficulty level of the game.

The buy down process is shown in greater detail in FIG. 5. In step 500 the machine checks to see if there are any credits available for buy down. If credits are not available, then the buy down process is not available to the player and the process moves to step 308. In another preferred embodiment, if no credits are available in step 500, the process instead moves to step 502, where the game unit 100 suggests that the player add additional coins, tokens or other monetary units in the receiver 140. The game unit 100 preferably includes a credit display 212 which indicates the number of credits the player has in the game unit 100, and which preferably also indicates the number of credits required to completely buy down the chosen prize 112. In step 502, if the player adds additional credits, the process then moves back to step 500. If the player chooses not to add additional credits, the process moves to step 308. In step 500, if credits are available, the process moves to step 504. In step 504, the game controller 200 senses if the slow down light button 134 has been depressed. If it has not, the process moves back to step 500, after which step 504 is repeated. The effect of this loop is to have the game unit 100 wait until the player decides whether the depress the slow down button 504. The active game light 116 is preferably moving as the player decides whether to buy down, so if the player decides not to buy down, the player may simply play the game, and the process moves to step 308. In step 504, if the game controller 200 senses that the slow lights button 136 is depressed, the process moves to step 506. The active game light 116 is slowed by one increment, and the number of credits is decreased by one. When the active game light 116 is slowed by one increment, it is preferably slowed by one difficulty level. As discussed above, in a preferred embodiment, there are a finite number of discrete difficulty levels. The player can spend a credit in reducing the difficulty level a discrete amount. In a preferred embodiment, each increment of value corresponds to the same increment of change in difficulty level. However, it is within the scope of the preferred embodiment to create a nonlinear relationship between each increment of value and the resultant increment of change in difficulty level, such that the increment of change in difficulty level may increase or decrease as the total value of the prize 112 increases. Thus, when the player presses the slow lights button 136, thereby transferring a credit to the game unit 100, the difficulty level of the skill game 106 decreases.

The process then moves to step 508. If the player has inserted a number of credits equal to the value of the prize 112, and presses the slow lights button 136 a corresponding number of times in order to use those credits to buy down the difficulty level of the skill game 106, then the active game light 116 stops at the win light 116. That is, the player may simply buy the prize 112 without playing the skill game 106. The process then moves to step 510 where the prize 112 is dispensed from the cabinet 102 through the prize dispensing door 142. Optionally, the process may move to step 512, which is a win mode where music or a lighting pattern may be played in celebration of the player's victory.

In step 508, if the active game light 116 has not completely stopped, the process moves back to step 500 where the game unit 100 checks to see if additional credits are available. In this way, the player may reduce the difficulty level of the skill game 106 by inserting additional coins or tokens into the receiver 140.

Figure 6:
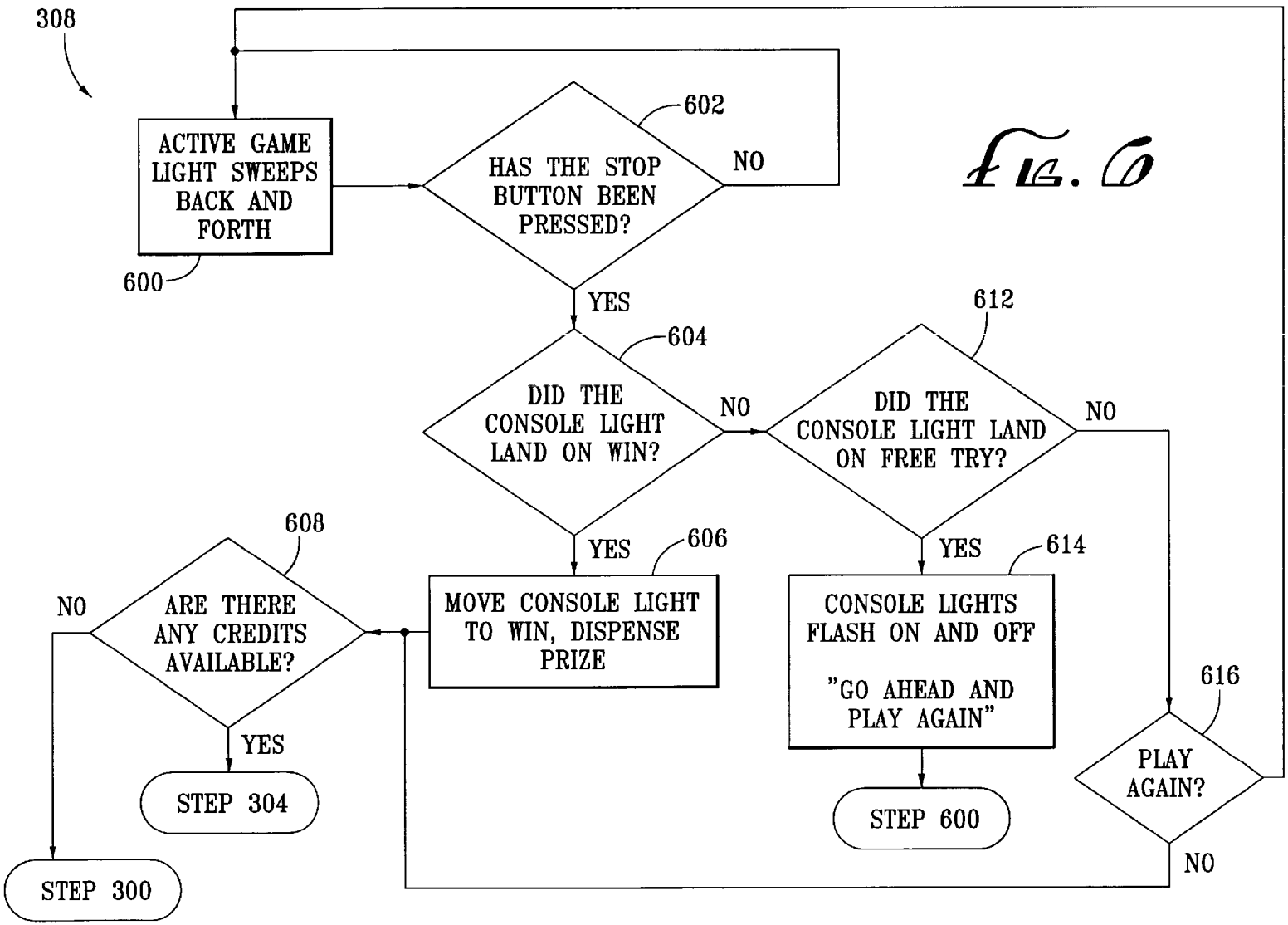
FIG. 6 is a flow chart illustrating the process of playing the game.

Referring back to FIG. 3, the process then moves to step 308, in which the game is played. The player can choose at any time to cease buying down the difficulty level in step 306 and play the game. Referring to FIG. 6, in step 600 the active game light 116 sweeps back and forth across the skill game 106. The speed with which the active game light 116 moves back and forth across the skill game 106 may be referred to as the sweep rate. The sweep rate depends on two factors, as discussed above: the value of the selected prize 112 and the additional credits added, if any, to slow down the speed of the active game light 116. In a preferred embodiment, the center light 116 is the win light 116. That is, if the player presses the stop button 138 while the active game light 116 is the win light 116, then the player wins the game. However, the win light 116 need not be located in the center of the skill game 106 and in fact may be located at either end or another location within the skill game 106. Also in a preferred embodiment, one or more additional lights are free try lights, where if the player presses the stop button 138 while the active game light 116 is on the free try light 116, the player does not win but that press of the stop button 138 does not count. The player may be given a single try to win after the player begins the game or the player may be given multiple tries. This is programmable and may be preset by the owner or operator of the game unit 100. The range of sweep rates between the lowest difficulty level and the highest difficulty level is preferably adjustable as well.

In step 602, the game controller 200 senses whether the stop button 138 has been pressed. If not, the game returns to step 600 and waits for the player to press the stop button 138. In this way, the active game light 116 sweeps back and forth until the player is ready to press the stop button 138. If the stop button 138 has been pressed, the process moves to step 604 where the game controller 200 checks whether the active game light 116 stopped at the win light 116. If so, the process moves to step 606, where the dispensing unit 104 dispenses the selected prize 12. Moving to step 608, if other credits are available, the game moves back to step 304. In step 608, if other credits are not available, then the process moves back to step 300 and the game unit 100 enters the attract mode.

Moving back to step 604, if the active game light 116 did not land on the win light 116, the process moves to step 612, where the game 100 checks to see if the active game light 116 landed on a free try light 116. If yes, the process moves to step 614 and the player is given the opportunity to play the skill game 106 again. If not, the process moves from step 612 to step 616. In step 616, the game controller 200 checks whether the player is allowed to play the game again. That is, the game controller 200 can be set to allow the player to play the skill game only once per credit, or multiple times per credit. If the player is allowed to play the skill game again, the process returns to step 600. If not, the game is over, and the game unit 100 returns to the attract mode.

It will be apparent to those skilled in the art that other skill games 106 may be substituted for the skill game 106 as described here. One such game is a cumulative game. A number of the game lights 116 are labeled with a symbol or a numeral, and other game lights 116 are labeled with symbols indicating a loss, or no symbols at all. Some game lights 116 may be labeled as free try lights, as discussed above. Play proceeds similarly to the skill game 106 disclosed above. The sweep rate of the active game light 116 increases as the value of the prize increases; the player presses the stop button 138 to stop the active game light 116. The selected prize 112 is associated with a numerical value, or a number of symbols. The player must stop the active game light 116 on the game lights marked with a symbol or numeral enough times to match the number of symbols associated with the prize, or collect a numerical value equal to or greater than the numerical value of the prize. The player may be given a fixed number of opportunities to do so, or may be allowed to play until the game controller 200 detects a preset number of stops on game lights 116 associated with a loss, or until a preset time is reached.

Another such skill game 106 is a spelling game. Twenty-six game lights 116 are provided, each labeled with a letter of the alphabet. Of course, different numbers of game lights 116 may be provided for use in countries having different alphabets containing more or less letters than the English alphabet. In this skill game, each prize is associated with a letter or letters. Low-value prizes may be identified with a single letter; higher-value prizes are identified with multiple letters. Play proceeds similarly to the skill game 106 disclosed above. If the player stops the active game light 116 on each game light marked with the letters associated with the selected prize 112, the player wins that prize. The player may be given a fixed number of opportunities to stop the active game light 116 on each letter associated with the selected prize 112, or may be allowed to play until a preset time is reached. Optionally, additional game lights 116 may be added, labeled with symbols indicating a loss, such that if the player stops the active game light 116 on one of those symbols one or more times, the skill game 106 will end.

While the elements of play of the skill game 106 may vary in those two games, and in other implementations of the skill game 106, the difficulty of winning the selected prize 112 still depends on the value of the selected prize 112. Further, the player still selects a specific prize before starting play. In addition, the buy down function allowing the player to reduce the difficulty level of the skill game 106 by purchasing additional credits is still preferably present, including the ability for a player to purchase the prize 112 outright without playing the skill game 106.

Preferably, the game unit 100 includes a tilt sensor 202 electrically connected to the game controller 200. The construction and operation of the tilt sensor 202 are well known to those skilled in the art. The tilt sensor 202 detects tilting of the machine, and transmits that detected tilting to the game controller 200. The game controller 200 will preferably issue a warning through the audio card 208 to one or more speakers 210 when the amount of tilt reaches a preset number of degrees. Preferably, if the game unit 100 is tilted further, the game controller 200 issues one or more commands to prevent prizes 112 from being dispensed from the dispensing unit 104. Such commands may include, but are not limited to, a command to lock the prize dispensing door 142, a command to sound an alarm, and a command to turn off the game unit 100.

Preferably, the game controller 200 is adapted to allow the operator of the game unit 100 flexibility in programming and/or presetting a number of quantities associated with the difficulty of the skill game 106, play of the skill game 106, and the cost of the skill game 106, as well as other quantities and values used in the operation of the game unit 100. Thus, it is within the scope of the preferred embodiment to allow for operator adjustment and customization of the game unit 100

A preferred arcade game, and many of its attendant advantages, has thus been disclosed. It will be apparent, however, that various changes may be made in the content and arrangement of the steps of the game or in the form and parts of the apparatus without departing from the spirit and scope of the invention, the method and apparatus hereinbefore described being merely preferred or exemplary embodiments thereof. Therefore, the invention is not to be restricted or limited except in accordance with the following claims and their legal equivalents.

What is claimed is:

1. A method for dispensing prizes from an arcade game unit to a player, comprising the steps of:

accepting monetary units from the player;

displaying the difficulty level of the game associated with a prize;

accepting selection of a prize by the player;

starting the game at a difficulty level corresponding to said selected prize;

determining whether the player won the game; and dispensing said selected prize to the player if the player has won the game.

2. The method of claim 1, further comprising the step before the accepting monetary units step of waiting in an attract mode.

3. The method of claim 2, wherein said waiting step comprises the steps of displaying the difficulty level of the game associated with a particular prize for a finite time and repeating the displaying step with a prize different from the immediately preceding prize.

4. The method of claim 1, wherein said displaying step is performed by lighting a vending light associated with a prize.

5. The method of claim 1, wherein said displaying step is performed for a plurality of different prizes.

6. The method of claim 4, further comprising the step of accepting input from the player, where said displaying step is performed for a specific prize in response to said input.

7. The method of claim 4, wherein said displaying step comprises the steps of displaying the difficulty level of the game associated with a particular prize for a finite time and repeating the displaying step with a prize different from the immediately preceding prize.

8. The method of claim 1, further comprising the step before the starting step of counting the monetary units accepted; and adjusting the difficulty level of the game according to said counted number of monetary units.

9. The method of claim 8, further comprising the step before the adjusting step of accepting a request from the player to decrease the difficulty level.

10. The method of claim 8, wherein said difficulty level decreases as the counted number of monetary units increases.

11. A method for dispensing a prize from an arcade game unit to a player, comprising the steps of:

accepting monetary units from the player;

displaying the difficulty level of the game associated with a prize;

accepting selection of a prize by the player; and dispensing said selected prize to the player if said accepted monetary units are equal to or greater than the value of the prize.

* * * * *